United States Patent [19]

Sado et al.

[11] 4,390,765

[45] Jun. 28, 1983

[54] RUBBER-MADE COVERING MEMBER FOR PUSH BUTTON SWITCHES

[75] Inventors: Ryoichi Sado, Saitama; Yoshitusgu Morikawa; Takekuni Okamoto, both of Tokyo; Kazutoki Tahara, Ageo, all of Japan

[73] Assignee: Shin-Etsu Polymer Co., Ltd., Tokyo, Japan

[21] Appl. No.: 267,662

[22] Filed: May 27, 1981

[30] Foreign Application Priority Data

Jun. 9, 1980 [JP] Japan ..... 55-77434

[51] Int. Cl.[3] ..... H01H 13/52

[52] U.S. Cl. ..... 200/159 B

[58] Field of Search ..... 200/159 B, 5 A, 340

[56] References Cited

U.S. PATENT DOCUMENTS

| | | | |
|---|---|---|---|
| 3,898,421 | 8/1975 | Suzumura | 200/159 B |
| 3,932,722 | 1/1976 | Obata et al. | 200/159 B |
| 4,127,758 | 11/1978 | Lowthorp | 200/34 G |
| 4,194,105 | 3/1980 | Hodges | 200/159 B |

*Primary Examiner*—John W. Shepperd

*Attorney, Agent, or Firm*—Hill, Van Santen, Steadman, Chiara & Simpson

[57] ABSTRACT

The invention provides a push button switch covering member integrally made of a rubbery elastomeric material having an improved structure with which a much larger key stroke is obtained before a snapping action takes place in the covering member when the member is pushed at the center portion leading to the contact of the contact points than in the conventional ones. The covering member is constructed of (a) a central pushing part, (b) a first annular portion which may be in a form of a truncated cone or a cup laid upside down and is connected to the central pushing part at the upper end, (c) a second annular portion encircling and connected to the first annular portion and (d) a base flat connected to the second annular portion, at which the covering member is mounted on the base board of the switch, the relationship between the strengths of the first and the second annular portions being such that the first annular portion does not undergo a buckling deformation before the second annular portion is substantially deformed or bent around the connecting line between the second annular portion and the base flat.

4 Claims, 5 Drawing Figures

RUBBER-MADE COVERING MEMBER FOR PUSH BUTTON SWITCHES

BACKGROUND OF THE INVENTION

The present invention relates to a rubber-made covering member for push button switches or, more particularly, relates to a rubber-made covering member for push button switches having improved structure suitable for use in key-board switching units in various kinds of information-processing instruments such as computers, electric typewriters and the like operated by an operator over a length of time.

The switch operation is most of the prior art push button switches utilizes a metal-made spring member or a rubber-made covering member in the form of a truncated cone or a dome exhibiting more or less a snapping action or a clicking action. Therefore, the stroke vs. load relationships expressed by graphical curves in these push button switches are usually not uniform but, when the pushing stroke of the push button is gradually increased, the load on the push button at first increases linearly while a miximum is reached at a stroke value beyond which the load suddenly decreases to a minimum point and then increases again as the stroke is further increased over the minimum point of the pushing load. That is, the sudden decrease in the pushing load from the above mentioned maximum to the minimum is caused by the snapping action or clicking action of the resilient member in the push button switch. The working point of the switch is in general at or near the minimum point, i.e. at the end of the snapping action. The increase in the stroke thereafter is called an overstroke caused by the compression of a certain member in the switch.

It is a general trend that those push button switches having a rubber-made covering member are preferred to those having metallic resilient members when the switch operation involves a snapping action of the resilient member because the overall key stroke can be made larger in the former than in the latter so that a larger versatility is obtained readily in controlling the touch of key pushing in the most comfortable and reliable way (see, for example, Japanese Patent Disclosure 50-47179). The snapping action of the resilient member in these push button switches is very important in preventing or reducing the phenomena of chattering or bouncing in the switch operation and, in the same time, the operator of the push button switch can obtain a reliable touch of switching-on of the push button switch when the snapping action of the resilient member takes place. In this respect, the length of the key stroke before the snapping action takes place or, in other words, up to the maximum point in the key stroke vs. pushing load curve is an important parameter on which the mental as well as muscular fatigue of the switch operator largely depends to smoothly conduct the switch operation with a minimum number of errors over a long period of continued operation works.

The optimum length of the key stroke before beginning of the snapping action may depend on several parameters of the push button switches. In a conventional key board type push button switch provided with a rubber-made covering member, of which the pitch in the key arrangement is 14 to 20 mm, the full key stroke is 2 to 4 mm and the maximum pushing load necessary for switch operation is 40 to 200 g, for example, it has been empirically established that the optimum key stroke before the snapping action is 1.0 to 1.8 mm from the standpoint of decreasing the fatigue of the operator.

In the actual design of the conventional push button switches having a rubber-made covering member with pushing portions in the form of a truncated cone or a dome, the key stroke before the snapping action cannot be so large as desired but is usually in the range from 0.3 to 1.0 mm as restricted by the general structure thereof so that the operator of the key board switches receives an accelerated feeling of fatigue. With an object to mitigate the feeling of fatigue of the operator, an improved push button switch of the above described type has been proposed in which a coiled spring member is provided as an auxiliary resilient member used in combination with the rubber-made covering member. Push button switches of this type are, however, disadvantageous practically because of the increased number of the parts to be assembled to the switch as well as the increased laboriousness in assembling the parts into the switch including the coiled spring to be handled with burdensomeness resulting in inevitably increased costs for manufacturing.

SUMMARY OF THE INVENTION

An object of the present invention is therefore to provide a novel and improved rubber-made covering member for a push button switch free from the above described problems in the prior art products, which is capable of giving a very comfortable touch to the operator's finger with the key stroke adjustable as desired.

The rubber-made covering member of push button switch of the present invention, which is mounted on a base board of the switch, provided with at least one fixed contact point, integrally shaped of a rubbery elastomer in a form of a truncated cone or a dome comprises (a) a central pushing part, (b) a first annular portion encircling and connected to the central pushing part, which is susceptible to a snapping action by the buckling deformation when the central pushing part is depressed by pushing, a second annular portion encircling and connected to the first annular portion, and (d) a base flat surrounding and connected to the second annular portion, at which the rubber-made covering member is mounted on the base board of the switch, the second annular portion being susceptible to substantial bending deformation around the connecting line between the second annular portion and the base flat at a load for depressing the central pushing part smaller than the load at which the first annular portion undergoes a buckling deformation.

DETAILED DESCRIPTION OF THE PREFERRED EMBODIMENTS

Figure 1:
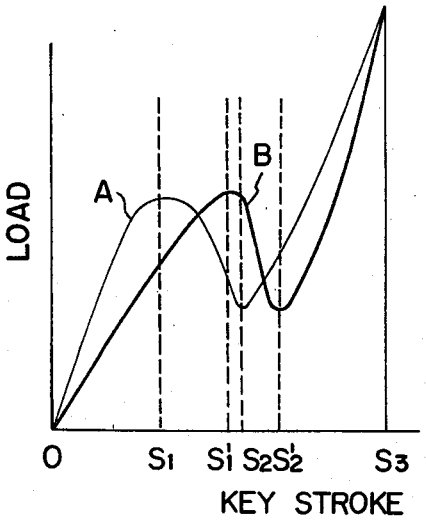
FIG. 1 is an illustrative graph showing the relationships between the key stroke and the pushing load in the conventional (curve A) and inventive (curve B) switch covering members.

As is described above, the comfortableness in the repeated operation of push button switches largely depends on the length of the key stroke before the snapping action of the resilient member takes place. FIG. 1 schematically illustrates the key stroke vs. pushing load relationships in a conventional and inventive push button switches having the same overall key stroke and maximum pushing load by the curves A and B, respectively. In the conventional pushing switch illustrated by the curve A, the key stroke and the pushing load are in a linearly proportional relationship at the initial stage of pushing. When the key stroke reaches a value $S_1$, the pushing load is suddenly decreased by the snapping action caused by the buckling deformation in the resilient member of the switch with a corresponding increase in the key stroke up to $S_2$ as a minimum point of the load, beyond which the pushing load again increases with the increase of the key stroke to the full stroke at $S_3$. As is mentioned before, the key stroke before the snapping action, i.e. the distance O-$S_1$, in the conventional push button switch can rarely exceed 1.0 mm.

In the inventive phase button switch shown by the curve B in FIG. 1, on the other hand, the key stroke before the snapping action is greatly extended to be in the desirable range of 1.0 to 1.8 mm as shown by the distance O-$S_1'$ with a slight shift of the minimum point $S_2'$ to the right but with unchanged overall key stroke O-$S_3$.

The structure of the inventive rubber-made covering member is now illustrated with reference to FIGS. 2 to 5, each illustrating a cross sectional view of a different embodiment as mounted on a base board of the switch.

Figure 2:
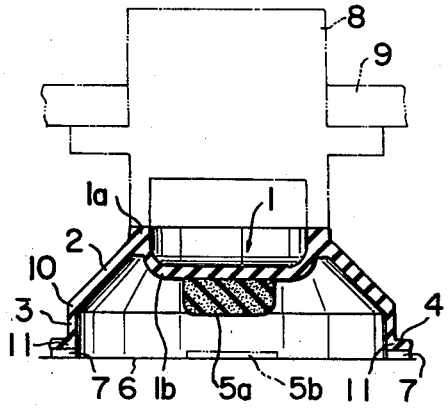
FIGS. 2 to 5 are each an axial cross sectional view of an embodiment of the invention switch covering member.

FIG. 2 illustrates an axial cross section of a typical embodiment of the inventive push-button switch covering member integrally made of a rubber. A key-board switch panel is usually provided with a number of such single switches with covering members shaped either separately or integrally in one sheet-like member. The switch covering member illustrated in FIG. 2 is formed of the parts of (a) a central pushing part 1, (b) a first annular portion 2 encircling and connected to the central pushing part 1 in a form of the side surface of a truncated cone, (c) a second annular portion 3 encircling and connected to the first annular portion 2 in a form having cylindrical surface, and (d) a base flat 4 surrounding and encircling the second annular portion 3, at which the covering member is mounted on a base board 6, with a spacer 7 therebetween, on which a fixed contact point **5*b* is provided as bonded thereto facing the movable contact point 5*a* bonded on to the lower surface of the diaphragm portion 1*b* of the central pushing part 1 so as that the movable contact point 5*a* is brought into contact with the fixed contact point 5*b* when the switch covering member is depressed at the central pushing part 1 by a finger tip or the like through a pushing button 8 mounted between the switch covering member and the upper board 9 of the key-board panel in contact with the ring-wise rib 1*a* of the central pushing part 1**.

In operating the push button switch illustrated in FIG. 2 by pushing the push button 8, the ring-wise rib **1*a* of the central pushing part 1 is depressed down which, at the first stage of pushing, causes an outward bending deformation in the second annular portion 3 with an enlargement of the diameter of the connecting line 10 between the first and the second annular portions 2 and 3. In other words, the second annular portion 3 is bent around the connecting line 11 between the second annular portion 3 and the base flat 4. This stage of pushing corresponds to the key stroke O-$S_1'$ in the curve B in FIG. 1. When the pushing load exceeds a certain value corresponding to the key stroke O-$S_1'$, the first annular portion 2 is brought under buckling deformation so that the pushing load is suddenly decreased in a snapping action to the value corresponding to $S_2'$ in FIG. 1 whereby the electric circuit between the fixed contact point 5*b* and the movable contact point 5*a*** is closed by the contact of them.

In order that the deformation of each of the parts of the covering member takes place in the above described order, it is essential that the pushing load necessary to cause the bending deformation of the second annular portion 3 around the connecting line 11 between the second annular portion 3 and the base flat 4 as a fulcrum is smaller than the pushing load necessary to cause the buckling deformation of the first annular portion 2. In the prior art switch covering members, on the other hand, the second annular portion is always not deformable or bendable before the first annular portion undergoes a buckling deformation so that the key stroke O-$S_1$ in FIG. 1 cannot be sufficiently large. In this model of the switch covering member of FIG. 2, the push button 8 can be further depressed down even after the movable contact point **5*a* has come to contact with the fixed contact point 5*b* by virtue of the deformation of the diaphragm portion 1*b* of the central pushing part 1** to give an adequate overstroke corresponding to the stroke $S_2'$-$S_3$ in the curve B of FIG. 1.

Figure 3:
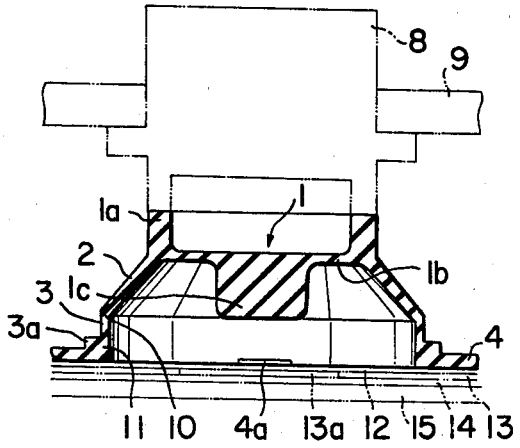

FIG. 3 illustrates a similar embodiment as a modification of FIG. 2 by the axial cross section, in which a ring-wise step **3*a* is provided along the connecting line 11 between the second annular portion 3 and the base flat 4 with an object to adequately control the bending deformation of the second annular portion 3 around the connecting line 11. This model is designed for indirect circuit closing so that the covering member is not provided with a movable contact point on the lower surface of the diaphragm portion 1*b* of the central pushing part 1. Instead, a downward protrusion 1*c* is formed on the lower surface of the central pushing part 1. Further, the covering member per se is not mounted directly on the base board but is mounted on an electroconductive diaphragm rubber sheet 12 which faces the fixed contact point on a base board 14 reinforced with a rigid backing plate 15 with a spacer sheet 13 having an opening 13*a* sandwiched therebetween so that, when the central pushing part 1 is depressed by the push button 8, the electric circuit is closed between the fixed contact point and the conductive diaphragm rubber sheet 12 by the downward depression of the latter as pushed with the protrusion 1*c*. An air escape 4*a* is formed on the lower surface of the base flat 4** to ensure smooth depression and resilient return of the covering member in the pushing with and releasing of the finger tip. The switching action of the covering member per se is not different from that in the model shown in FIG. 2.

Figure 4:
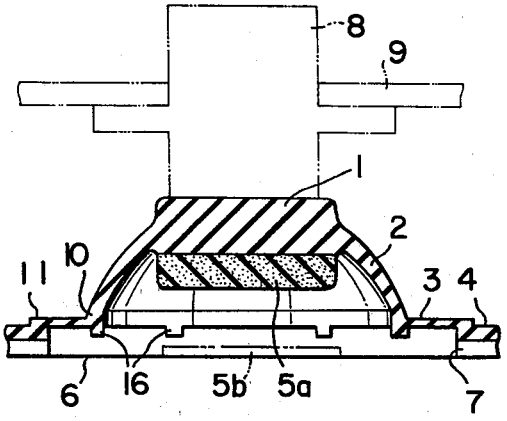

FIG. 4 illustrates a further different embodiment of the inventive switch covering member by the axial cross section. In this model, the central pushing part 1 is made thick as a whole instead of being formed of the diaphragm portion **1*b* and the ring-wise rib 1*a* in the model shown in FIG. 2. The first annular portion 2 encircling and connected to the central pushing part 1 is in a form of something like a cup laid upside down. Different from the cylindrical second annular portion 3 in the model shown in FIG. 2, the second annular portion 3 in this case is made in an annular flat connected at the inside peripheral line 10 to the lower end of the first annular portion 2. The second annular portion 3 is further connected to the base flat 4 at the outer peripheral line 11 to be in a form of something like an annular step. A plural number of knob-like protrusions 16, which may be integrated altogether into a ring-wise rib, are provided facing downwardly along the connecting line 10 between the first and the second annular portions 2 and 3. When the central pushing part 1 is pushed down with a finger tip either directly or through the push button 8 mounted thereon, the second annular portion, i.e. the annular flat, 3 is bent downwardly around the connecting line 11 between the second annular portion 3 and the base flat 4 with the reversed cup-like first annular portion 2 keeping its original form almost unchanged so that the knob-like protrusions 16 first come into contact with the base board 6. The buckling deformation of the first annular portion 2 takes place with a snapping action only thereafter and the movable contact point 5***a* bonded to the lower surface of the central pushing part 1 comes into contact with the fixed contact point 5*b* on the base board 6 closing the electric circuit therebetween. In other words, it is essential that the switch covering member illustrated in FIG. 4 should be so designed that the second annular portion 3 is susceptible to bending deformation around the connecting line 11 between the base flat 4 and the second annular portion 3 at a pushing load on the central pushing part 1 smaller than the load at which the buckling deformation of the first annular portion 2 takes place.

Figure 5:
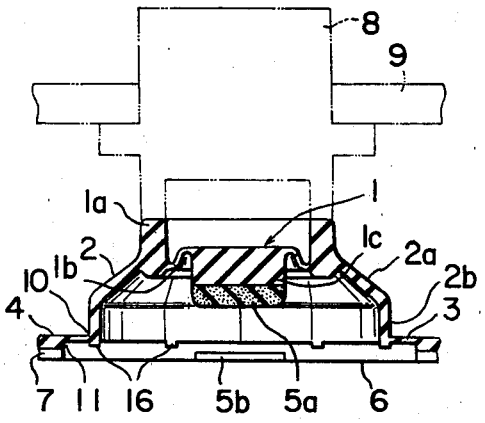

FIG. 5 illustrates a further modification of the model shown in FIG. 4 by the axial cross section. In this model, the first annular portion 2 is divided into the portion 2*a* of the form of a truncated cone and the portion 2*b* of the cylindrical form and the central pushing part 1 is composed of the ring-wise rib 1*a*, diaphragm portion 1*b* and thick-walled portion 1*c*. When a pushing load is applied to the central pushing part 1 or rather to the ring-wise rib 1*a* through the push button 8 mounted thereon, the second annular portion 3 is first bent around the connecting line 11 between the base flat 4 and the second annular portion 3 bringing the knob-like protrusions 16 into contact with the base board 6 and thereafter the deformation of the first annular portion 2 takes place first at the lower cylindrical portion 2*b* bulging outwardly around the connecting line 10 followed by the buckling deformation of the upper conical portion 2*a* with a snapping action whereby the movable contact point 5*a* bonded to the lower surface of the central thick-walled portion 1*c* becomes contacted with the fixed contact point 5*b* on the base board 6 to close the electric circuit therebetween.

As is understood from the above description with reference to the drawing, the stroke of the switch pushing before the snapping action can be made much larger in the inventive switch covering member illustrated in FIGS. 2 to 5 than in conventional ones. For example, the stroke before the snapping action can be as large as 1.0 to 1.8 mm in the invention when the full key stroke is set at 2 to 4 mm while conventional ones can give only 0.3 to 1.0 mm of the stroke before the snapping action with the same full key stroke of 2 to 4 mm. This improvement is very remarkable in reducing the fatique of a key operator even in a long run operation of the switches.

Needless to say, the stroke before the snapping action can be adjusted to a desired optimum length in the inventive switch covering member. This adjustment is possible mainly by an appropriate design of the second annular portion 3 in respect of the dimensions and/or the cross sectional configuration. For example, the stroke in the models shown in FIGS. 2 and 3 can be adjusted by suitably determining the thickness and height of the cylindrical second annular portion 3 and the stroke in the model shown in FIG. 4 can be adjusted by modifying the cross sectional configuration or dimensions of the second annular portion or the annular flat 3 including the downward knob-like protrusions 16.

What is claimed is:

1. A push button switch covering member integrally shaped of a rubbery elastomeric material which comprises (a) a central pushing part having a downwardly facing protrusion, (b) a first annular portion encircling and connected to the central pushing part, which is susceptible to a snapping action by the buckling deformation when the central pushing part is depressed by pushing, (c) a second annular portion encircling and connected to the first annular portion, and (d) a base flat surrounding and connected to the second annular portion, at which the push button switch covering member is mounted on a base board of the switch with said protrusion facing said base board, said base flat including a fixed contact lying below said protrusion, the second annular portion having a cylindrical configuration connected at one end to the first annular portion and to the base flat at the other end and being capable of being deformed, when the central pushing part is depressed by pushing, in such a manner that the diameter of the circular connecting line between the first and second annular portions is increased before the first annular portion undergoes a buckling deformation.

2. A push button switch covering member integrally shaped of a rubbery elastomeric material which comprises (a) a central pushing part having a downwardly facing contact, (b) a first annular portion encircling and connected to the central pushing part, which is susceptible to a snapping action by a buckling deformation when the central pushing part is depressed by pushing, (c) a second annular portion encircling and connected to the first annular portion, and (d) a base flat surrounding and connected to the second annular portion, at which the push button switch covering member is mounted on a base board of the switch with said protrusion facing said base board, said base flat having a fixed contact thereon for engagement with said downwardly facing contact, the second annular portion having a flat annular configuration parallel to the base flat as connected to the first annular portion at the inner periphery and connected to the base flat at the outer periphery and capable of being bent toward the base board around the connecting line between the second annular portion and the base flat when the central pushing part is depressed by pushing before the first annular portion undergoes a buckling deformation.

3. The push button switch covering member as claimed in claim 2 wherein at least one knob-like protrusion is provided on the second annular portion along the connecting line between the first and the second annular portions facing the base board.

4. A push button switch covering member integrally shaped of a rubbery elastomeric material which comprises:

(a) a central pushing part having a downwardly facing contact, (b) a first annular portion encircling and connected to the central pushing part, which is susceptible to a snapping action by the buckling deformation when the central pushing part is depressed by pushing, (c) a second annular portion encircling and connected to the first annular portion, and (d) a base flat surrounding and connected to the second annular portion at which the push button switch covering member is mounted on a base board of the switch with said contact facing said base board, said base flat having a fixed contact lying below said downwardly facing contact, the second annular portion having a cylindrical configuration connected at one end to the first annular portion and to the base flat at the other end and being capable of being deformed, when the central pushing part is depressed by pushing, in such a manner that the diameter of the circular connecting line between the first and second annular portions is increased before the first annular portion undergoes a buckling deformation.

* * * * *